US010604303B1

(12) United States Patent
Mataya

(10) Patent No.: US 10,604,303 B1
(45) Date of Patent: Mar. 31, 2020

(54) MODULAR BAG

(71) Applicant: Marc Mataya, Charlotte, NC (US)

(72) Inventor: Marc Mataya, Charlotte, NC (US)

( * ) Notice: Subject to any disclaimer, the term of this patent is extended or adjusted under 35 U.S.C. 154(b) by 0 days.

(21) Appl. No.: 16/106,399

(22) Filed: Aug. 21, 2018

(51) Int. Cl.

| | |
|---|---|
| ***B65D 30/06*** | (2006.01) |
| ***B65D 33/06*** | (2006.01) |
| ***A45C 7/00*** | (2006.01) |
| *A45C 3/00* | (2006.01) |

(52) U.S. Cl.
CPC ..... *B65D 29/04* (2013.01); *A45C 7/009* (2013.01); *B65D 33/065* (2013.01); *A45C 2003/002* (2013.01)

(58) Field of Classification Search
CPC ..... B65D 29/04; B65D 33/065; A45C 7/009; A45C 2003/002
USPC ..... 383/4, 117
See application file for complete search history.

(56) References Cited

U.S. PATENT DOCUMENTS 2,442,105 A * 5/1948 Vacheron ..... A47G 9/066 2/69.5
2,554,688 A * 5/1951 Vollweiler ..... A45F 4/04 135/95
3,590,864 A * 7/1971 Vechesloff ..... A41D 15/04 135/95
3,831,316 A * 8/1974 Weistrop ..... A63H 3/003 446/74
4,918,794 A * 4/1990 Harvey ..... A44B 19/262 24/411
5,690,444 A * 11/1997 Yuuki ..... A44B 19/262 403/268
5,769,106 A * 6/1998 Achuff ..... A41D 15/04 135/95
8,544,922 B1 * 10/2013 Huzar ..... B60P 7/0876 294/157
D765,929 S * 9/2016 Mataya ..... D32/35
2006/0062493 A1 * 3/2006 Chu ..... A45C 7/0068 383/2
2013/0136381 A1 * 5/2013 Waldorf ..... A45C 3/00 383/6

* cited by examiner

*Primary Examiner* — Jes F Pascua

(57) ABSTRACT

The modular bag is a configurable containment system. The modular bag comprises a mesh sheeting, a plurality of zippers, a plurality of handles, and a plurality of anchor points. The plurality of zippers, the plurality of handles, and the plurality of anchor points attach to the mesh sheeting. The modular bag lies flat on a horizontal surface when fully extended. When the modular bag is fully extended, the modular bag forms a mesh that can be used as a netting. The plurality of zippers interconnect such that the modular bag can be configured into storage bags of various sizes. The plurality of handles forms grips that allows for the manipulation of the modular bag by hand. The plurality of anchor points form attachment points that allows for the attachment of the modular bag to objects.

15 Claims, 12 Drawing Sheets

MODULAR BAG

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles, more specifically, a hand carried bag convertible into an open planar surface, and which is breathable.

SUMMARY OF INVENTION

The modular bag is a configurable containment system. The modular bag comprises a mesh sheeting, a plurality of zippers, a plurality of handles, and a plurality of anchor points. The plurality of zippers, the plurality of handles, and the plurality of anchor points attach to the mesh sheeting. The modular bag lies flat on a horizontal surface when fully extended. When the modular bag is fully extended, the modular bag forms a mesh that can be used as a netting or as a sun screen. The plurality of zippers interconnect such that the modular bag can be configured into bags of various sizes. The plurality of handles forms grips that allows for manipulation of the modular bag by hand. The plurality of anchor points form attachment points that allow for the attachment of the modular bag to objects. In a second potential embodiment of the disclosure, the modular bag further comprises a plurality of pickets, one or more pockets, and a label panel. The plurality of pickets further converts the modular bag into a canopy. The plurality of pickets are further used to carry or tie down the modular bag. The one or more pockets provided securable storage pouches that allows for the storage of small items with the modular bag. The label panel allows the visible display of messages on the modular bag.

These together with additional objects, features and advantages of the modular bag will be readily apparent to those of ordinary skill in the art upon reading the following detailed description of the presently preferred, but nonetheless illustrative, embodiments when taken in conjunction with the accompanying drawings.

In this respect, before explaining the current embodiments of the modular bag in detail, it is to be understood that the modular bag is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the modular bag.

It is therefore important that the claims be regarded as including such equivalent construction insofar as they do not depart from the spirit and scope of the modular bag. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
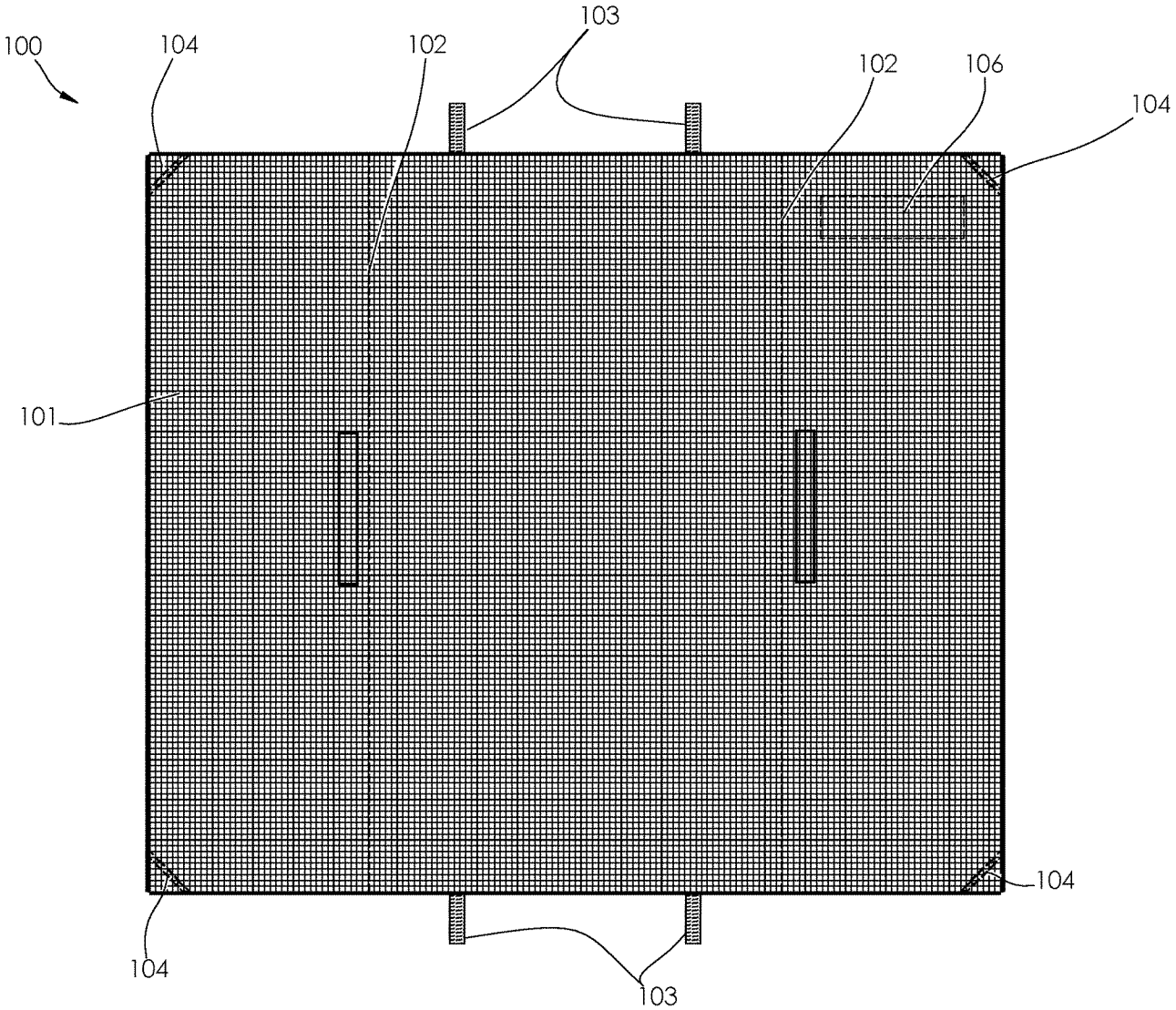
FIG. 1 is a front expanded view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 12.

The modular bag 100 (hereinafter invention) is a configurable containment system. The invention 100 comprises a mesh sheeting 101, a plurality of zippers 102, a plurality of handles 103, and a plurality of anchor points 104. The plurality of zippers 102, the plurality of handles 103, and the plurality of anchor points 104 attach to the mesh sheeting

101. The invention 100 lies flat on a horizontal surface when fully extended. When the invention 100 is fully extended, the invention 100 forms a mesh that can be used as a netting. The plurality of zippers 102 interconnect such that the invention 100 can be configured into storage bags of various sizes. The plurality of handles 103 forms grips that allows for manipulation of the invention 100 by hand. The plurality of anchor points 104 form attachment points that allows for the attachment of the invention 100 to objects. The mesh sheeting 101 is of no particular size, which implies that the invention 100 can be scaled up or down depending on the particular needs. The mesh sheeting 101 is able to lie fully open and flat on the ground surface.

The mesh sheeting 101 is a commercially-available mesh textile, which is formed from polyvinylchloride coated nylon yarns. The mesh sheeting 101 has a rectangular shape. The mesh sheeting 101 is the physical structure that forms the exterior surfaces of the containers formed by the invention 100. The mesh sheeting 101 is the physical structure that forms the exterior surfaces of the container structures formed by the invention 100. The mesh sheeting 101 is the physical structure that forms the exterior surfaces of the netting structures formed by the invention 100.

The mesh sheeting 101 is further defined with a first edge 201, a second edge 202, a third edge 203, a fourth edge 204, a first corner 211, a second corner 212, a third corner 213, and a fourth corner 214. The first corner 211 of the mesh sheeting 101 is a right angle formed by the first edge 201 and the second edge 202. The second corner 212 of the mesh sheeting 101 is a right angle formed by the second edge 202 and the third edge 203. The third corner 213 of the mesh sheeting 101 is a right angle formed by the third edge 203 and the fourth edge 204. The fourth corner 214 of the mesh sheeting 101 is a right angle formed by the fourth edge 204 and the first edge 201.

The first edge 201 is further defined with a first edge midpoint 221. The first edge midpoint 221 is located on the first edge 201 at a position equidistant between the fourth corner 214 and the first corner 211. The third edge 203 is further defined with a third edge midpoint 223. The third edge midpoint 223 is located on the third edge 203 at a position equidistant between the second corner 212 and the third corner 213.

The second edge 202 is further defined with a second edge midpoint 222, a first second edge 222 quarter point 251, and a second second edge 222 quarter point 252. The second edge midpoint 222 is located on the second edge 202 at a position equidistant between the first corner 211 and the second corner 212. The first second edge 222 quarter point 251 is located on the second edge 202 at a position equidistant between the first corner 211 and the second edge midpoint 222. The second second edge 222 quarter point 252 is located on the second edge 202 at a position equidistant between the second edge midpoint 222 and the second corner 212.

The fourth edge 204 is further defined with a fourth edge midpoint 224, a first fourth edge 224 quarter point 253, and a second fourth edge 224 quarter point 254. The fourth edge midpoint 224 is located on the fourth edge 204 at a position equidistant between the third corner 213 and the fourth corner 214. The first fourth edge 224 quarter point 253 is located on the fourth edge 204 at a position equidistant between the fourth corner 214 and the fourth edge midpoint 224. The second fourth edge 224 quarter point 254 is located on the fourth edge 204 at a position equidistant between the fourth edge midpoint 224 and the third corner 213.

Each of the plurality of zippers 102 is a fastening device. Each of the plurality of zippers 102 comprises a first interlocking structure, a second interlocking structure, and a fastening mechanism. Any initial zipper selected from the plurality of zippers 102 is identical with any subsequent zipper selected from the plurality of zippers 102 such that an interlocking structure of the primary zipper will fasten to an interlocking structure of the subsequent zipper. The various configurations provided by the invention 100 are achieved by manipulating the interactions between the interlocking structures of each of the plurality of zippers 102.

The plurality of zippers 102 comprises a first zipper 111, a second zipper 112, a third zipper 113, a fourth zipper 114, and a fifth zipper 115.

The first zipper 111 is a commercially available zipper. The span of the length of the first zipper 111 equals the span of the length of the first edge 201 of the mesh sheeting 101. The first zipper 111 comprises a first flexible interlocking edge 231, a second flexible interlocking edge 232, and a first pull 181. The first flexible interlocking edge 231 is the first interlocking structure of the first zipper 111. The second flexible interlocking edge 232 is the second interlocking structure of the first zipper 111. The first pull 181 may be constructed of a commercially available textile webbing that attaches to the first zipper 111. The first pull 181 forms a grip used to open and close sipper combinations involving the first zipper 111.

The second zipper 112 is a commercially available zipper. The span of the length of the second zipper 112 equals the span of the length of the third edge 203 of the mesh sheeting 101. The second zipper 112 comprises a third flexible interlocking edge 233, a fourth flexible interlocking edge 234, and a second pull 182. The third flexible interlocking edge 233 is the first interlocking structure of the second zipper 112. The fourth flexible interlocking edge 234 is the second interlocking structure of the second zipper 112. The second pull 182 may be constructed of a commercially available textile webbing that attaches to the second zipper 112. The second pull 182 forms a grip used to open and close sipper combinations involving the second zipper 112.

The third zipper 113 is a commercially available zipper. The span of the length of the third zipper 113 equals one quarter of the span of the length of the second edge 202 of the mesh sheeting 101. The third zipper 113 comprises a fifth flexible interlocking edge 235, a sixth flexible interlocking edge 236, and a third pull 183. The fifth flexible interlocking edge 235 is the first interlocking structure of the third zipper 113. The sixth flexible interlocking edge 236 is the second interlocking structure of the third zipper 113. The third pull 183 may be constructed of a commercially available textile webbing that attaches to the third zipper 113. The third pull 183 forms a grip used to open and close sipper combinations involving the third zipper 113.

The fourth zipper 114 is a commercially available zipper. The span of the length of the fourth zipper 114 equals one quarter of the span of the length of the second edge 202 of the mesh sheeting 101. The fourth zipper 114 comprises a seventh flexible interlocking edge 237, an eighth flexible interlocking edge 238, and a fourth pull 184. The seventh flexible interlocking edge 237 is the first interlocking structure of the fourth zipper 114. The eighth flexible interlocking edge 238 is the second interlocking structure of the fourth zipper 114. The fourth pull 184 may be constructed of a commercially available textile webbing that attaches to the fourth zipper 114. The fourth pull 184 forms a grip used to open and close sipper combinations involving the fourth zipper 114.

The fifth zipper 115 is a commercially available zipper. The span of the length of the fifth zipper 115 equals one quarter of the span of the length of the second edge 202 of the mesh sheeting 101. The fifth zipper 115 comprises a ninth flexible interlocking edge 239, a tenth flexible interlocking edge 240, and a fifth pull 185. The ninth flexible interlocking edge 239 is the first interlocking structure of the fifth zipper 115. The tenth flexible interlocking edge 240 is the second interlocking structure of the fifth zipper 115. The fifth pull 185 may be constructed of a commercially available textile webbing that attaches to the fifth zipper 115. The fifth pull 185 forms a grip used to open and close sipper combinations involving the fifth zipper 115.

Each of the plurality of handles 103 is a textile based webbing that attaches to the mesh sheeting 101. Each of the plurality of handles 103 are identical. Each of the plurality of handles 103 is a loop grip that allows for the handling and manipulation of the invention 100. The plurality of handles 103 comprises a first handle 121, a second handle 122, a third handle 123, and a fourth handle 124.

The first handle 121 is a commercially available textile webbing that forms a loop on the first edge 201 of the mesh sheeting 101. The second handle 122 is a commercially available textile webbing that forms a loop on the first edge 201 of the mesh sheeting 101. The third handle 123 is a commercially available textile webbing that forms a loop on the third edge 203 of the mesh sheeting 101. The fourth handle 124 is a commercially available textile webbing that forms a loop on the third edge 203 of the mesh sheeting 101.

Each of the plurality of anchor points 104 is a textile based webbing that attaches to the mesh sheeting 101. Each of the plurality of anchor points 104 forms an attachment point that allows objects, including a picket selected from the plurality of pickets 105, to attach to the mesh sheeting 101. The plurality of anchor points 104 comprises a first anchor point 131, a second anchor point 132, a third anchor point 133, and a fourth anchor point 134.

The first anchor point 131 is a commercially available textile webbing that forms an anchor point at the first corner 211 of the mesh sheeting 101. The second anchor point 132 is a commercially available textile webbing that forms an anchor point at the second corner 212 of the mesh sheeting 101. The third anchor point 133 is a commercially available textile webbing that forms an anchor point at the third corner 213 of the mesh sheeting 101. The fourth anchor point 134 is a commercially available textile webbing that forms an anchor point at the fourth corner 214 of the mesh sheeting 101.

In a second potential embodiment of the disclosure, the invention 100 further comprises a plurality of pickets 105, one or more pockets 106, and a label panel 107. The plurality of pickets 105 further converts the invention 100 into a canopy or a sun screen. The plurality of pickets 105 are further used to carry the invention 100. The one or more pockets 106 provided securable storage pouches that allow for the storage of small items with the invention 100. The label panel 107 allows the visible display of messages on the invention 100.

Each of the plurality of pickets 105 is a shaft used to support the mesh sheeting 101 above a horizontal surface. Each of the plurality of pickets 105 are identical. As shown most clearly in FIG. 9, the shaft of a picket selected from the plurality of pickets 105 further forms a handle used to transport the invention 100. The plurality of pickets 105 comprises a first picket 141, a second picket 151, a third picket 161, and a fourth picket 171. The plurality of pickets may be constructive in a telescoping arrangement so as to enable adjustment of lengths as needed.

The first picket 141 is the picket selected from the plurality of pickets 105 that is associated with the first anchor point 131. The first picket 141 comprises a first shaft 142, a first tip 143, and a first pointed tip 144. The first shaft 142 is the shaft that forms the primary structure of the first picket 141. The first tip 143 is the working element of the first shaft 142 that attaches to the first anchor point 131. The first pointed tip 144 is the working element of the first shaft 142 that is driven into a horizontal surface.

The second picket 151 is the picket selected from the plurality of pickets 105 that is associated with the second anchor point 132. The second picket 151 comprises a second shaft 152, a second tip 153, and a second pointed tip 154. The second shaft 152 is the shaft that forms the primary structure of the second picket 151. The second tip 153 is the working element of the second shaft 152 that attaches to the second anchor point 132. The second pointed tip 154 is the working element of the second shaft 152 that is driven into a horizontal surface.

The third picket 161 is the picket selected from the plurality of pickets 105 that is associated with the third anchor point 133. The third picket 161 comprises a third shaft 162, a third tip 163, and a third pointed tip 164. The third shaft 162 is the shaft that forms the primary structure of the third picket 161. The third tip 163 is the working element of the third shaft 162 that attaches to the third anchor point 133. The third pointed tip 164 is the working element of the third shaft 162 that is driven into a horizontal surface.

The fourth picket 171 is the picket selected from the plurality of pickets 105 that is associated with the fourth anchor point 134. The fourth picket 171 comprises a fourth shaft 172, a fourth tip 173, and a fourth pointed tip 174. The fourth shaft 172 is the shaft that forms the primary structure of the fourth picket 171. The fourth tip 173 is the working element of the fourth shaft 172 that attaches to the fourth anchor point 134. The fourth pointed tip 174 is the working element of the fourth shaft 172 that is driven into a horizontal surface.

Each of the one or more pockets 106 is a pouch that is formed on the mesh sheeting 101. The one or more pockets 106 are used to store small and incidental objects.

Figure 8:
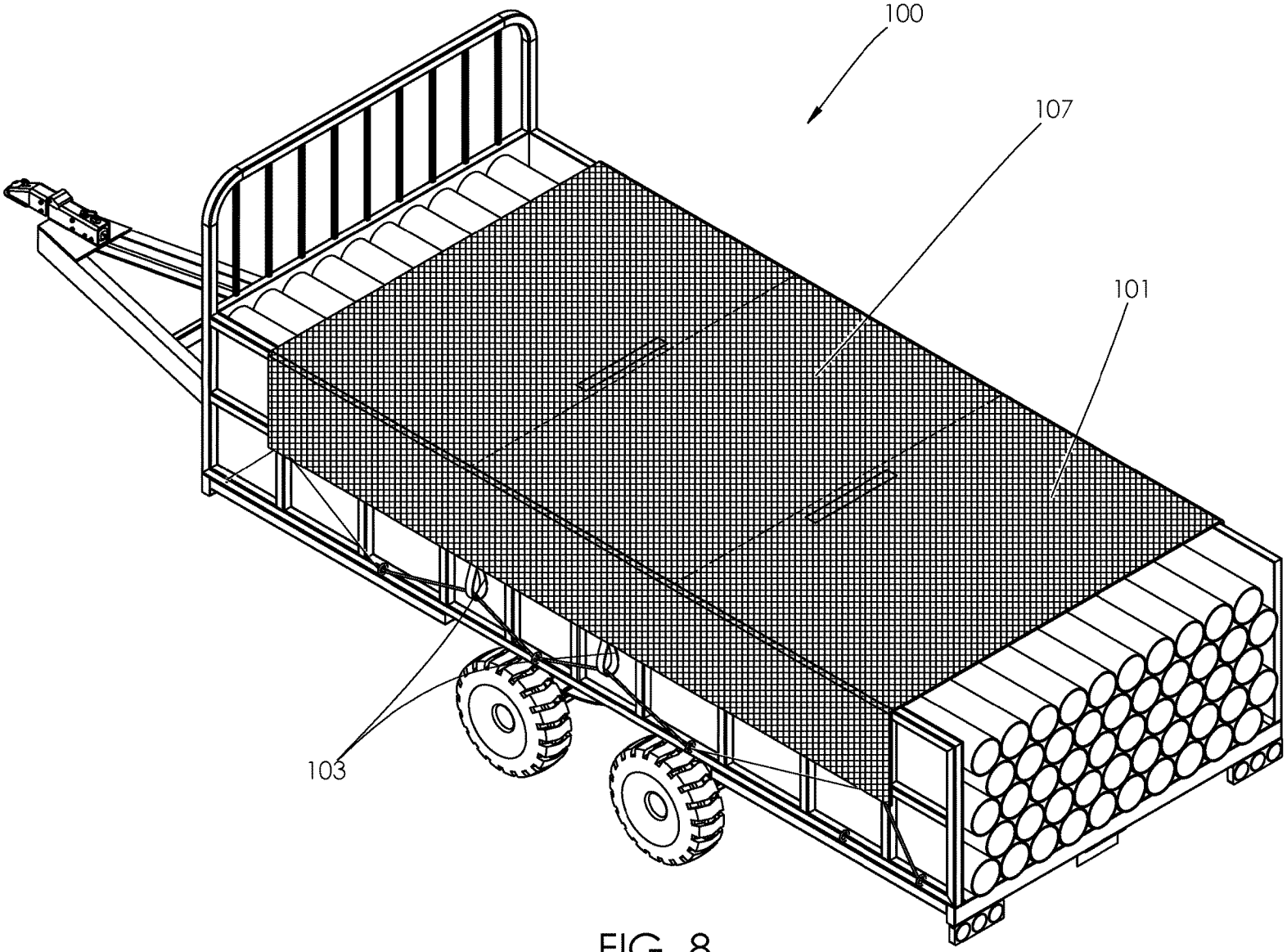
FIG. 8 is an in-use view of an embodiment of the disclosure.

As shown most clearly in FIG. 8, the label panel 107 is a message that is visually displayed on the mesh sheeting 101. In the first potential embodiment of the disclosure, the applicant assumes that the label panel 107 is a sheeting that attaches to the mesh sheeting 101.

The following nine paragraphs describe the assembly of the invention 100.

The first flexible interlocking edge 231 of the first zipper 111 attaches to the first edge 201 from the fourth corner 214 to the first corner 211. The second flexible interlocking edge 232 of the first zipper 111 attaches to face of the mesh sheeting 101 from the fourth edge midpoint 224 of the fourth edge 204 to the second edge midpoint 222 of the second edge 202. The third flexible interlocking edge 233 of the second zipper 112 attaches to face of the mesh sheeting 101 from the fourth edge midpoint 224 of the fourth edge 204 to the second edge midpoint 222 of the second edge 202. The fourth flexible interlocking edge 234 of the second zipper 112 attaches to the third edge 203 from the third corner 213 to the second corner 212.

The fifth flexible interlocking edge 235 of the third zipper 113 attaches to the fourth edge 204 from the fourth corner 214 to the first fourth edge 224 quarter point 253. The sixth flexible interlocking edge 236 of the third zipper 113 attaches to the second edge 202 from the first corner 211 to the first second edge 222 quarter point 251. The seventh flexible interlocking edge 237 of the fourth zipper 114 attaches to the fourth edge 204 from the first fourth edge 224 quarter point 253 to the fourth edge midpoint 224. The eighth flexible interlocking edge 238 of the fourth zipper 114 attaches to the second edge 202 from the first second edge 222 quarter point 251 to the second edge midpoint 222.

The ninth flexible interlocking edge 239 of the fifth zipper 115 attaches to the fourth edge 204 from the fourth edge midpoint 224 to the second fourth edge 224 quarter point 254. The tenth flexible interlocking edge 240 of the fifth zipper 115 attaches to the second edge 202 from the second edge midpoint 222 to the second edge 222 quarter point 252.

The first anchor point 131 attaches to the first edge 201 and the second edge 202 such that the first anchor point 131 forms a triangle with the first corner 211. The second anchor point 132 attaches to the second edge 202 and the third edge 203 such that the second anchor point 132 forms a triangle with the second corner 212. The third anchor point 133 attaches to the third edge 203 and the fourth edge 204 such that the third anchor point 133 forms a triangle with the third corner 213. The fourth anchor point 134 attaches to the fourth edge 204 and the first edge 201 such that the fourth anchor point 134 forms a triangle with the fourth corner 214.

The first tip 143 of the first picket 141 attaches to an end of the first shaft 142 of the first picket 141. The first tip 143 of the first picket 141 attaches to the first anchor point 131. The first pointed tip 144 of the first picket 141 is formed on the end of the first shaft 142 of the first picket 141 that is distal from the first tip 143.

The second tip 153 of the second picket 151 attaches to an end of the second shaft 152 of the second picket 151. The second tip 153 of the second picket 151 attaches to the second anchor point 132. The second pointed tip 154 of the second picket 151 is formed on the end of the second shaft 152 of the second picket 151 that is distal from the second tip 153.

The third tip 163 of the third picket 161 attaches to an end of the third shaft 162 of the third picket 161. The third tip 163 of the third picket 161 attaches to the third anchor point 133. The third pointed tip 164 of the third picket 161 is formed on the end of the third shaft 162 of the third picket 161 that is distal from the third tip 163.

The fourth tip 173 of the fourth picket 171 attaches to an end of the fourth shaft 172 of the fourth picket 171. The fourth tip 173 of the fourth picket 171 attaches to the fourth anchor point 134. The fourth pointed tip 174 of the fourth picket 171 is formed on the end of the fourth shaft 172 of the fourth picket 171 that is distal from the fourth tip 173.

The following eight paragraphs describe the potential configurations of the invention 100.

Figure 5:
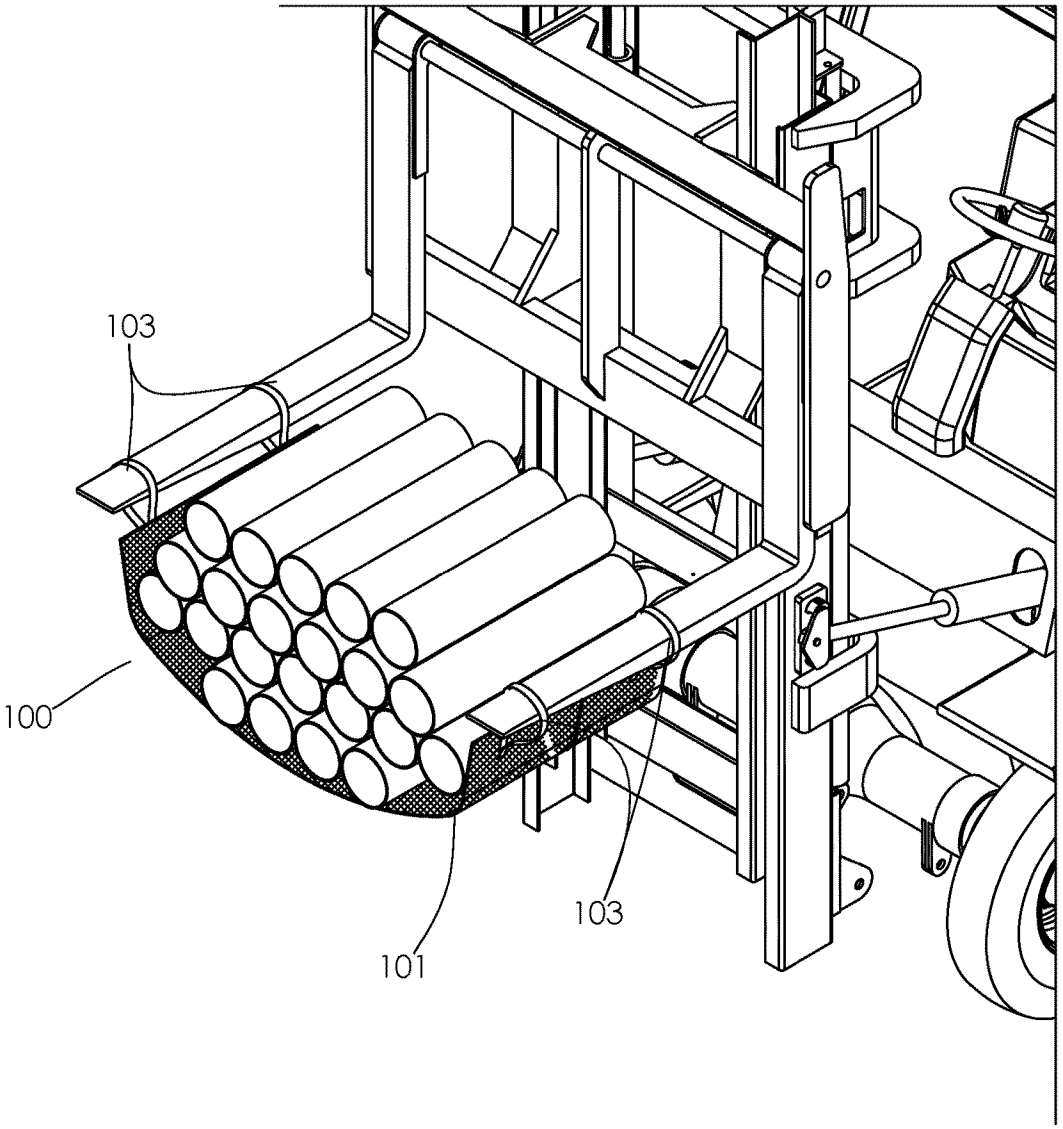
FIG. 5 is an in-use view of an embodiment of the disclosure.

As shown most clearly in FIG. 5, to use the invention 100 as a hammock to carry a load, each of the plurality of zippers 102 are unfastened. As shown most clearly in FIG. 11 to use the invention 100 as a net to capture objects carried in a fluid flow, each of the plurality of zippers 102 are unfastened. As shown most clearly in FIG. 8 to use the invention 100 as a cargo net each of the plurality of zippers 102 are unfastened.

Figure 10:
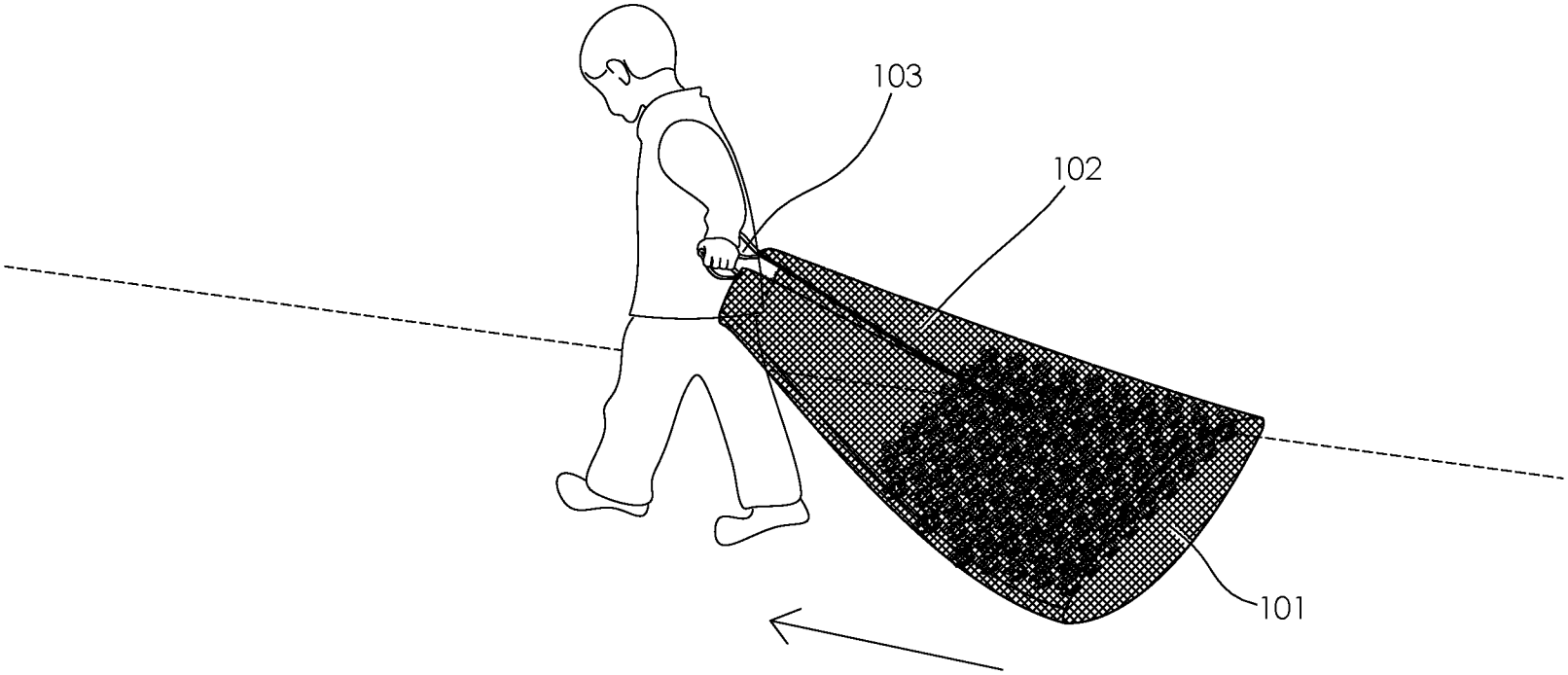
FIG. 10 is an in-use view of an embodiment of the disclosure.
Figure 11:
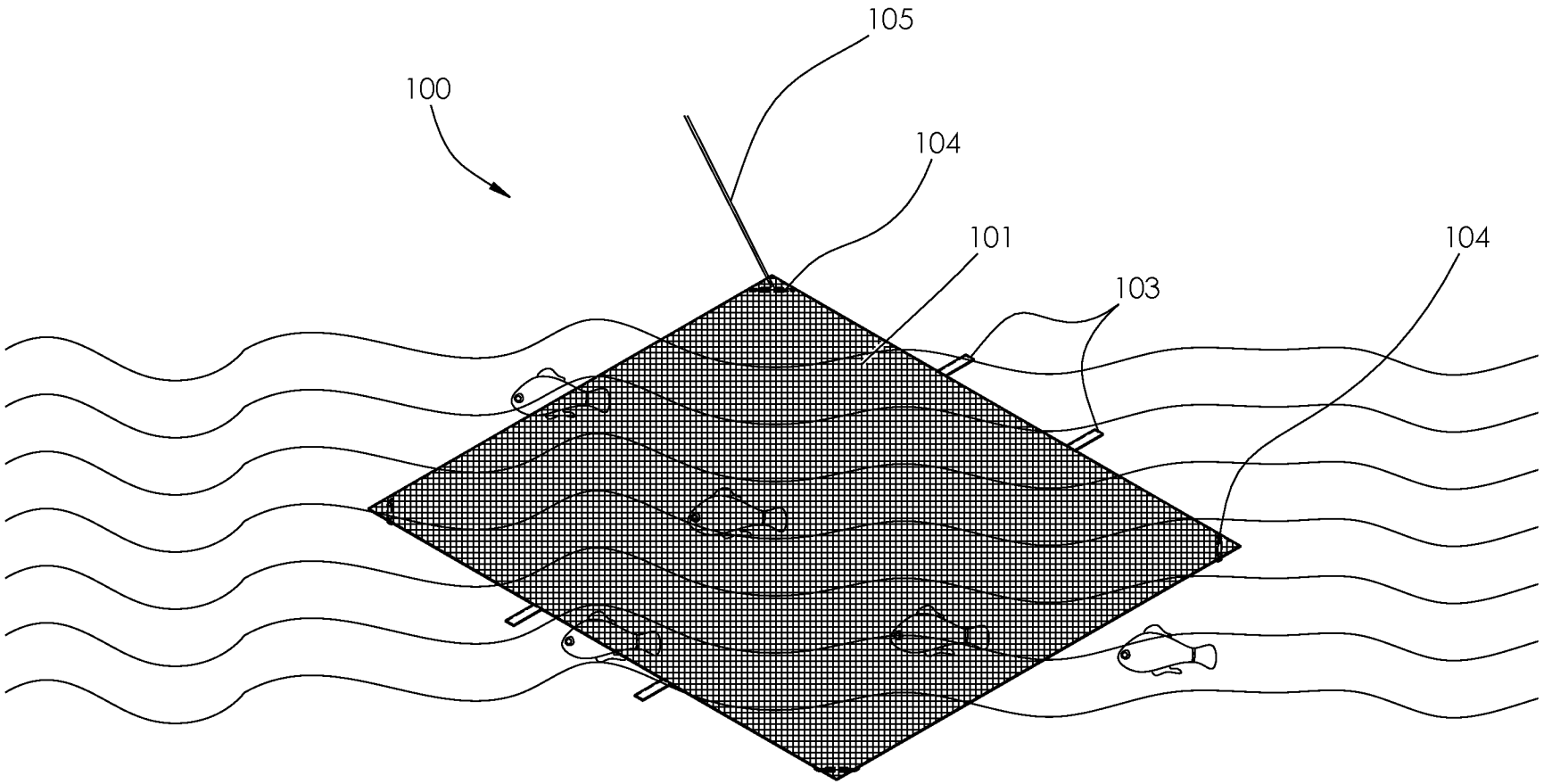
FIG. 11 is an in-use view of an embodiment of the disclosure.
Figure 12:
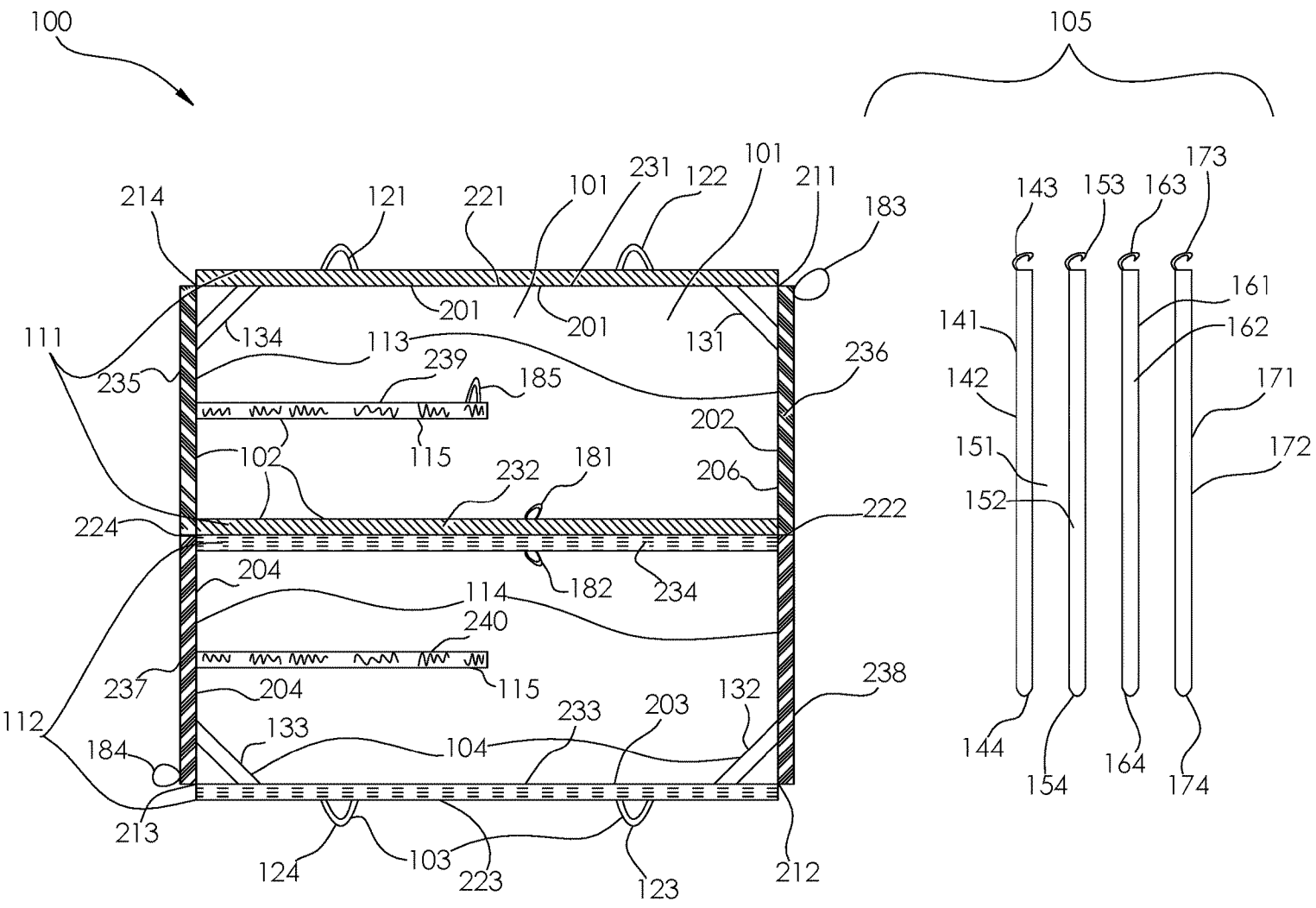
FIG. 12 is a front detail view of an embodiment of the disclosure.

As shown most clearly in FIG. 10 to configure the invention 100 as a single bag of maximum volume: a) the invention 100 of the first zipper 111 attaches to the fourth flexible interlocking edge 234 of the second zipper 112; b) the seventh flexible interlocking edge 237 of the fourth zipper 114 attaches to the ninth flexible interlocking edge 239 of the fifth zipper 115.

Figure 2:
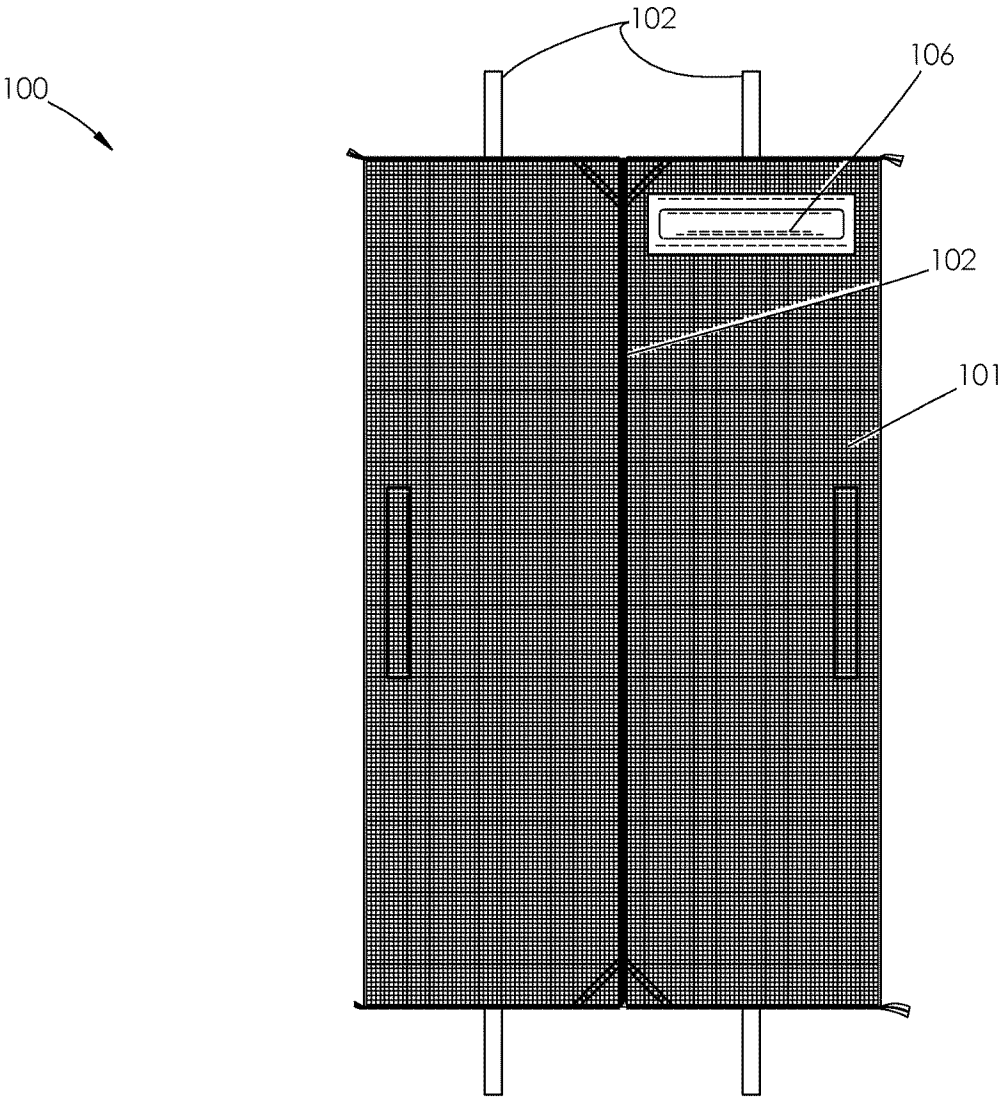
FIG. 2 is a front in use view of an embodiment of the disclosure.
Figure 3:
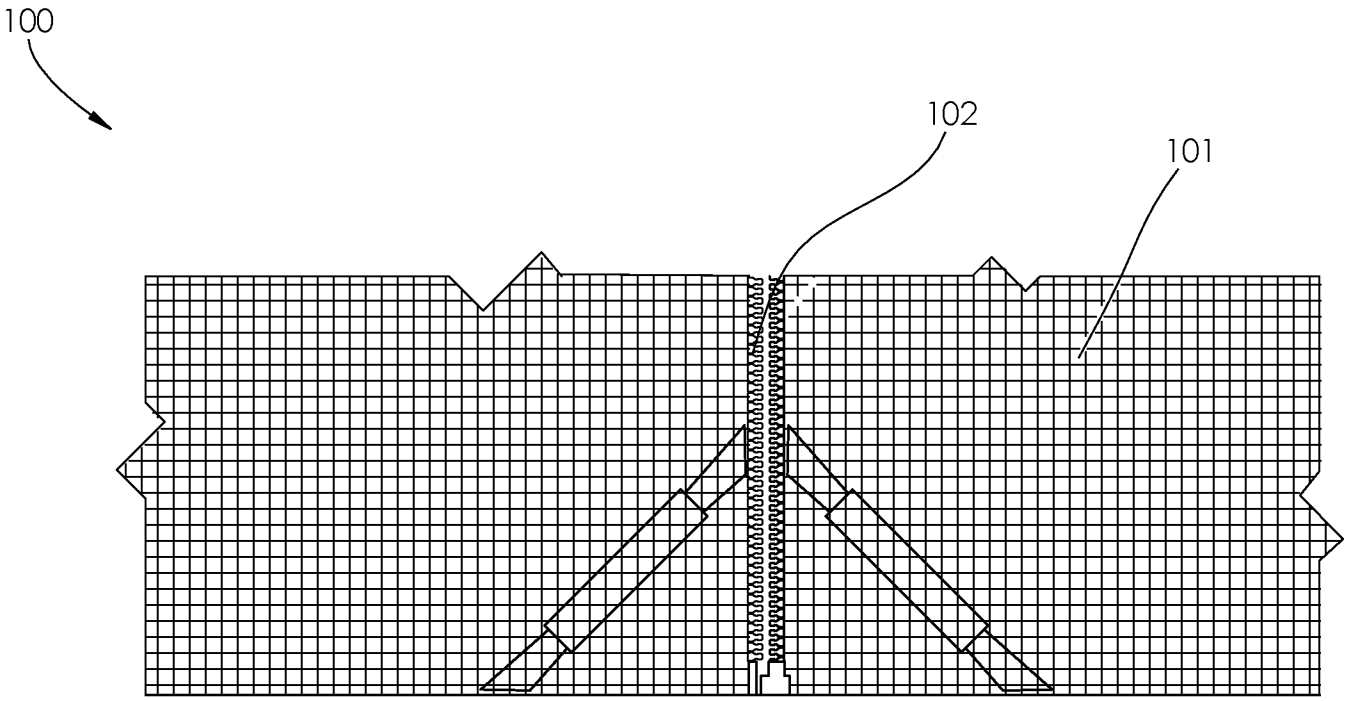
FIG. 3 is a detail view of an embodiment of the disclosure.
Figure 4:
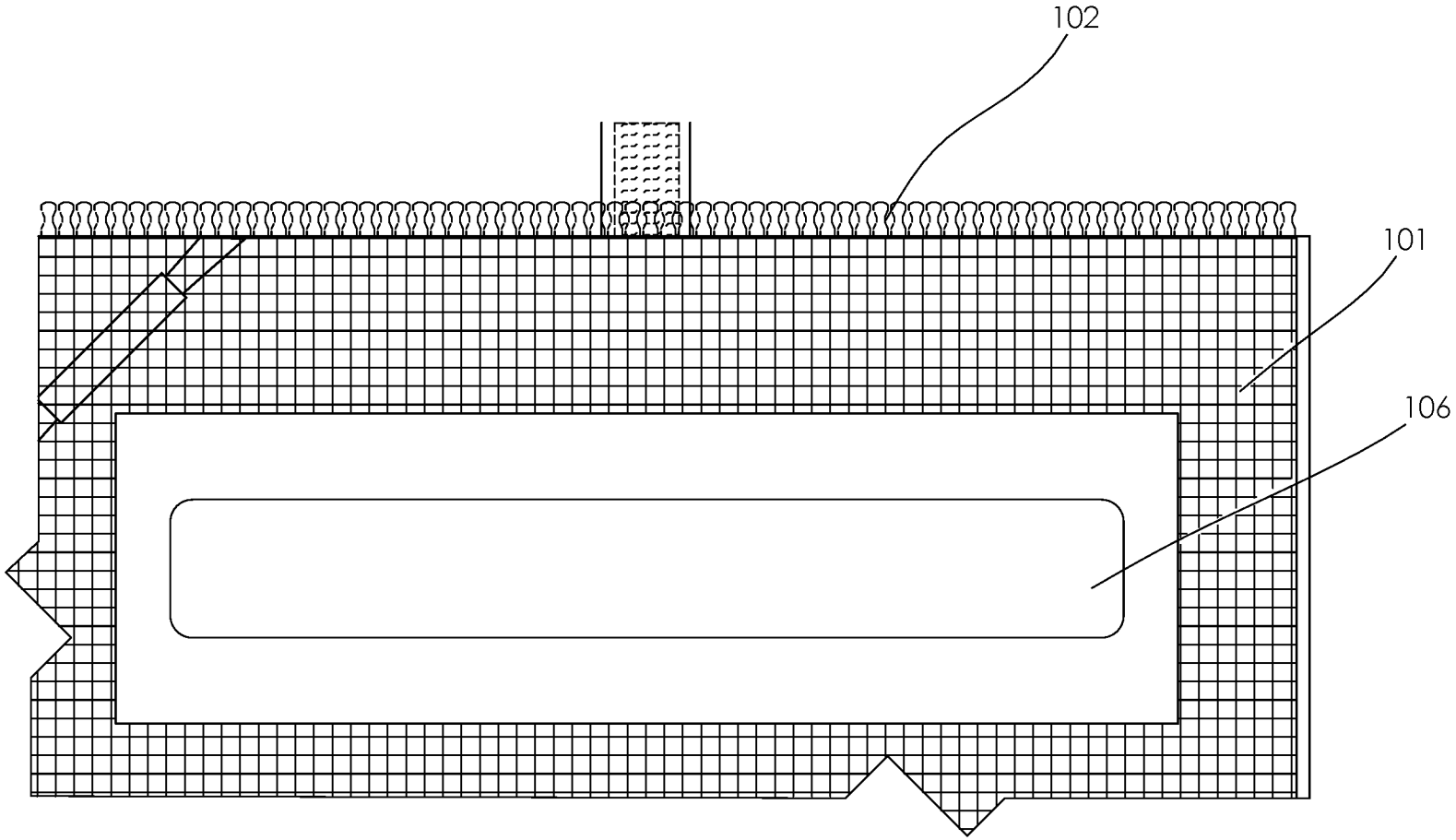
FIG. 4 is a detail view of an embodiment of the disclosure.

As shown most clearly in FIG. 2 to configure the invention 100 as a single fully closed chamber: a) the outer edge (231) of the first zipper 111 secures to the outer edge (234) of the second zipper 112; b) both elements of the new fourth zipper 114 secures to the corresponding elements of the new fifth zipper 115.

Figure 9:
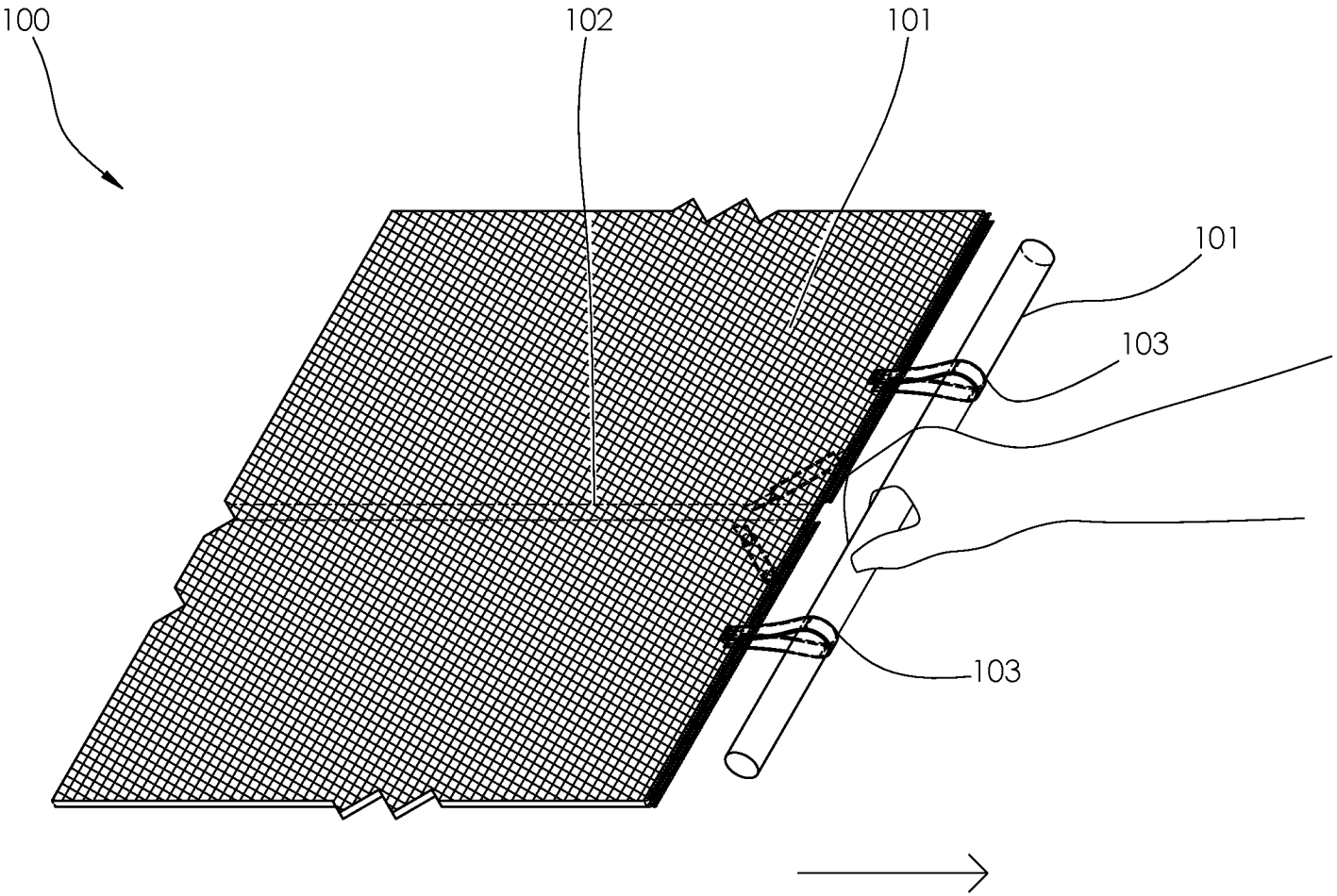
FIG. 9 is an in-use view of an embodiment of the disclosure.

As shown most clearly in FIG. 9 to configure the invention 100 for storage: a) the first flexible interlocking edge 231 of the first zipper 111 attaches to the second flexible interlocking edge 232 of the first zipper 111; b) the fourth flexible interlocking edge 234 of the second zipper 112 attaches to the third flexible interlocking edge 233 of the fourth zipper 114; c) the fifth flexible interlocking edge 235 of the third zipper 113 attaches to the sixth flexible interlocking edge 236 of the third zipper 113; d) the seventh flexible interlocking edge 237 of the fourth zipper 114 attaches to the eighth flexible interlocking edge 238 of the fourth zipper 114; e) the ninth flexible interlocking edge 239 of the fifth zipper 115 attaches to the tenth flexible interlocking edge 240 of the fifth zipper 115.

Figure 6:
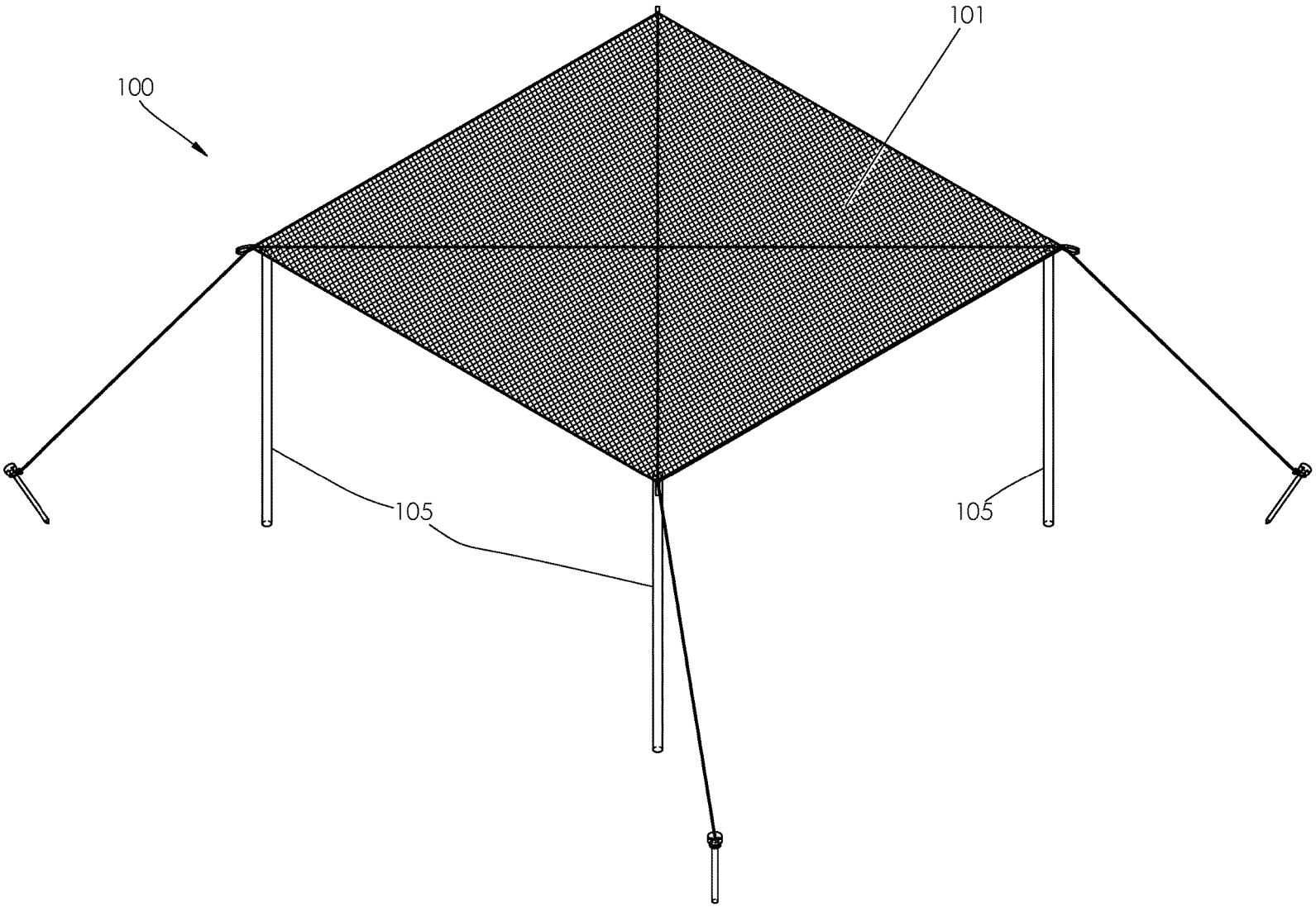
FIG. 6 is an in-use view of an embodiment of the disclosure.

As shown most clearly in FIG. 6, to use the invention 100 as a canopy, the first tip 143 of the first picket 141 tips onto the first anchor point 131 while the first pointed tip 144 is driven into a horizontal surface. Similarly, the second tip 153 of the second picket 151 tips onto the second anchor point 132 while the second pointed tip 154 is driven into a horizontal surface. The third tip 163 of the third picket 161 tips onto the third anchor point 133 while the third pointed tip 164 is driven into a horizontal surface. The fourth tip 173 of the fourth picket 171 tips onto the fourth anchor point 134 while the fourth pointed tip 174 is driven into a horizontal surface.

Figure 7:
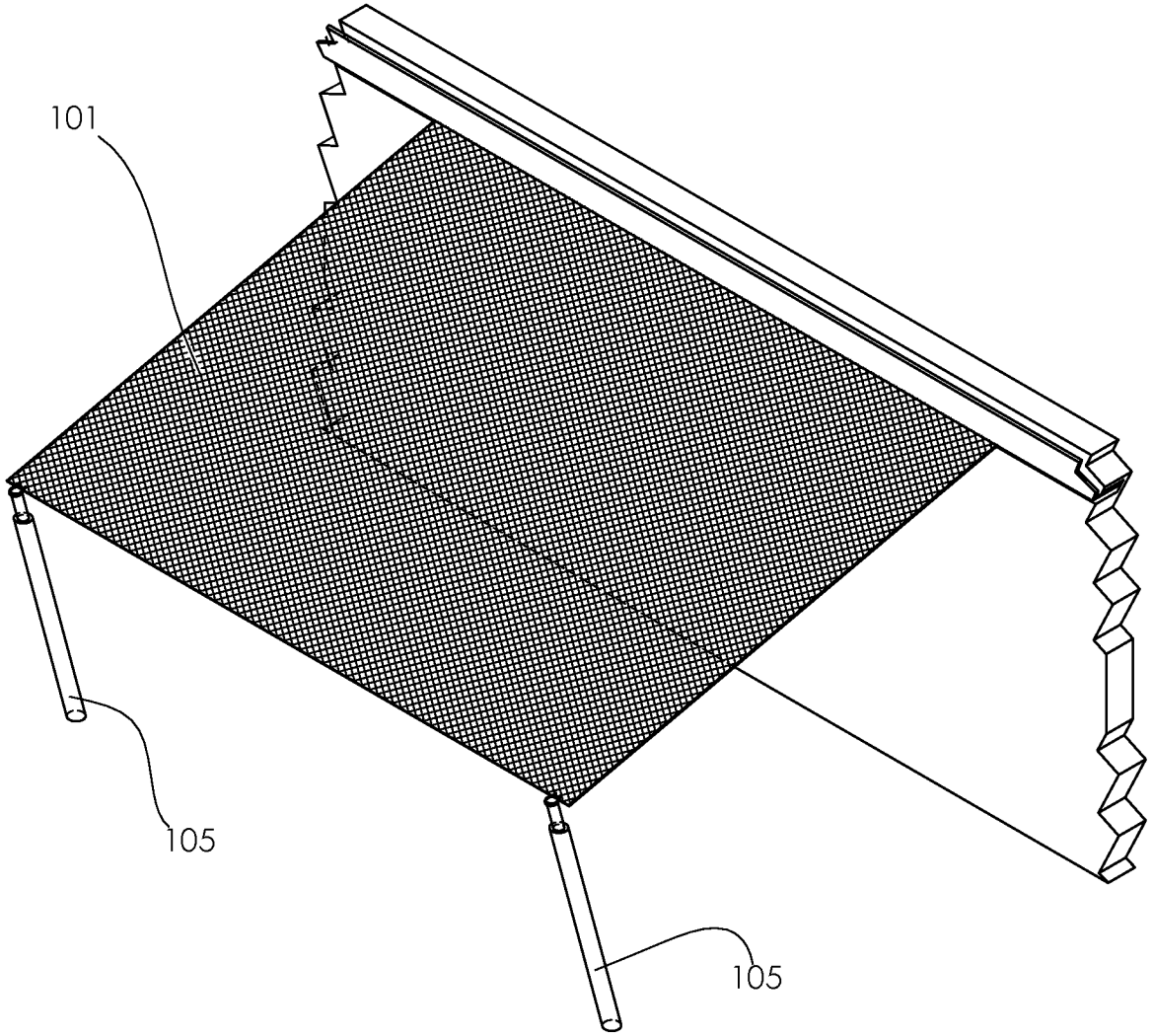
FIG. 7 is an in-use view of an embodiment of the disclosure.

As shown most clearly in FIGS. 6 and 7 to use the invention 100 as a canopy supported by the plurality of pickets 105, the plurality of zippers 102 are unfastened.

The following definitions were used in this disclosure:

Amide: As used in this disclosure, an amide is a functional group with a structure selected from the group consisting of: R1-(C═O)—(NH2), R1-(C═O)—(NH—R2), and R1-(C═O)—(NR2-R3). In this configuration, R1, R2, and R3 are organic molecules and R2 and R3 bond directly to the nitrogen (N). A polyamide refers to a polymer chain where the monomers are joined using an amide bond.

Anchor: As used in this disclosure, anchor means to hold an object firmly or securely.

Anchor Point: As used in this disclosure, an anchor point is a location to which a first object can be securely attached to a second object.

Bag: As used in this disclosure, a bag is a container made of a flexible material. The bag has multiple openings, which allows the bag to receive the items for containment.

Canopy: As used in this disclosure, a canopy is a cover, usually made of fabric that is placed above an area and creates a protected area offering protection to people or objects from the environment.

Copolymer: As used in this disclosure, a copolymer is a polymer formed from two or more repeating molecules (also referred to as monomers).

Fastener: As used in this disclosure, a fastener is a device that is used to removably join or affix two objects. Fasteners generally comprise a first element which is attached to the first object and a second element which is attached to the second object such that the first element and the second element join to removably attach the first object and the second object. Common fasteners include, but are not limited to, tips, zippers, magnets, snaps, buttons, buckles, quick release buckles, or tip and loop fasteners.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Incidental: As used in this disclosure, incidental refers to a second object that is associated with a first object but that: 1) does not significantly affect the characteristics of the first object; and, 2) the function of which can be readily replaced by or substituted with a third object.

Mesh: As used in this disclosure, the term mesh refers to an openwork fabric made from threads, yarns, cords, wires, or lines that are woven, knotted, or otherwise twisted or intertwined at regular intervals. Synonyms for mesh include net.

Monomer: As used in this disclosure, a monomer refers to a molecular structure that bonds to itself in a repeating manner to form a polymer.

Nylon: As used in this disclosure, nylon (CAS: Type 6: 25038-54-5; Type 6,6: 32131-17-2) refers to a polyamide polymer chain.

Picket: As used in this disclosure, a picket is a prism-shaped shaft with a narrowing or point formed at one of the congruent ends of the prism.

Pocket: As used in this disclosure, a pocket is a small pouch or storage space formed into an object. Pockets are often formed by joining a second textile or a second sheeting to a first textile or a first sheeting, respectively, by sewing or heat sealing respectively. Methods to form pockets are well-known and documented in the textile and apparel arts.

Polymer: As used in this disclosure, a polymer refers to a molecular chain that comprises multiple repeating units known as monomers. The repeating unit may be an atom or a molecular structure.

Polyvinylchloride: As used in this disclosure, polyvinylchloride (CAS 9006-86-2) refers to a polymer formed from vinyl chloride (CAS 75-01-4). The structure of vinyl chloride is CH2=CClH. The common abbreviation for polyvinylchloride is PVC.

Shaft: As used in this disclosure, a shaft is a long, narrow and rigid prism structure that is used as: 1) a structural element of a larger object; or 2) as a grip or lever for a handle. Shafts often have a prism shape.

Sheeting: As used in this disclosure, a sheeting is a material, such as a textile, a plastic, or a metal foil, in the form of a thin flexible layer or layers.

Textile: As used in this disclosure, a textile is a material that is woven, knitted, braided or felted. Synonyms in common usage for this definition include fabric and cloth.

Tip: As used in this disclosure, a tip is the pointed or rounded end or extremity of something slender or tapering, and such that items can be hung on or caught by the object, which may involve a grommet.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips. Webbings have tensile strength but are too flexible to provide compressive strength and are not suitable for use in pushing objects.

Working Element: As used in this disclosure, the working element of a tool is the physical element on the tool that performs the actual activity, operation, or procedure the tool is designed to perform. For example, the cutting edge of a blade is the working element of a knife.

Zipper: As used in this disclosure, a zipper is a fastening device comprising two flexible strips with interlocking components that are opened and closed by pulling a slide along the two flexible strips.

With respect to the above description, it is to be realized that the optimum dimensional relationship for the various components of the invention described above and in FIGS. 1 through 12 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A convertible structure comprising:

a mesh sheeting, a plurality of zippers, a plurality of handles, and a plurality of anchor points;

wherein the plurality of zippers, the plurality of handles, and the plurality of anchor points attach to the mesh sheeting;

wherein the convertible structure lies open and flat on a horizontal surface when fully extended;

wherein the convertible structure forms a mesh;

wherein the plurality of zippers interconnect such that the convertible structure can be configured into storage bags of varying lengths;

wherein the plurality of handles forms grips;

wherein the plurality of anchor points form attachment points;

wherein the plurality of zippers comprises a first zipper, a second zipper, a third zipper, a fourth zipper, and a fifth zipper;

wherein the first zipper comprises a first flexible interlocking edge, a second flexible interlocking edge, and a first pull;

wherein the mesh sheeting is a mesh textile;

wherein the mesh sheeting has a rectangular shape;

wherein the mesh sheeting is further defined with a first edge, a second edge, a third edge, a fourth edge, a first corner, a second corner, a third corner, and a fourth corner;

wherein the first corner of the mesh sheeting is a right angle formed by the first edge and the second edge;

wherein the second corner of the mesh sheeting is a right angle formed by the second edge and the third edge;

wherein the third corner of the mesh sheeting is a right angle formed by the third edge and the fourth edge;

wherein the fourth corner of the mesh sheeting is a right angle formed by the fourth edge and the first edge;

wherein the first edge is further defined with a first edge midpoint;

wherein the first edge midpoint is located on the first edge at a position equidistant between the fourth corner and the first corner;

wherein the third edge is further defined with a third edge midpoint;

wherein the third edge midpoint is located on the third edge at a position equidistant between the second corner and the third corner;

wherein the second edge is further defined with a second edge midpoint, a first second edge quarter point, and a second second edge quarter point;

wherein the second edge midpoint is located on the second edge at a position equidistant between the first corner and the second corner;

wherein the first second edge quarter point is located on the second edge at a position equidistant between the first corner and the second edge midpoint;

wherein the second second edge quarter point is located on the second edge at a position equidistant between the second edge midpoint and the second corner;

wherein the fourth edge is further defined with a fourth edge midpoint, a first fourth edge quarter point, and a second fourth edge quarter point;

wherein the fourth edge midpoint is located on the fourth edge at a position equidistant between the third corner and the fourth corner;

wherein the first fourth edge quarter point is located on the fourth edge at a position equidistant between the fourth corner and the fourth edge midpoint;

wherein the second fourth edge quarter point is located on the fourth edge at a position equidistant between the fourth edge midpoint and the third corner;

wherein each of the plurality of zippers is a fastening device;

wherein each of the plurality of zippers comprises a first interlocking structure, a second interlocking structure, and a fastening mechanism;

wherein any initial zipper selected from the plurality of zippers is identical with any subsequent zipper selected from the plurality of zippers such that an interlocking structure of the primary zipper will fasten to an interlocking structure of the subsequent zipper;

wherein each of the plurality of handles is a textile based webbing;

wherein each of the plurality of handles attaches to the mesh sheeting;

wherein each of the plurality of anchor points is a textile based webbing that attaches to the mesh sheeting;

wherein each of the plurality of anchor points forms an attachment point that allows objects to attach to the mesh sheeting;

wherein the first flexible interlocking edge is the first interlocking structure of the first zipper;

wherein the second flexible interlocking edge is the second interlocking structure of the first zipper;

wherein the first pull is a textile webbing that attaches to the first zipper;

wherein the first pull forms a grip;

wherein the second zipper comprises a third flexible interlocking edge, a fourth flexible interlocking edge, and a second pull;

wherein the third flexible interlocking edge is the first interlocking structure of the second zipper;

wherein the fourth flexible interlocking edge is the second interlocking structure of the second zipper;

wherein the second pull is a textile webbing that attaches to the second zipper;

wherein the second pull forms a grip;

wherein the third zipper comprises a fifth flexible interlocking edge, a sixth flexible interlocking edge, and a third pull;

wherein the fifth flexible interlocking edge is the first interlocking structure of the third zipper;

wherein the sixth flexible interlocking edge is the second interlocking structure of the third zipper;

wherein the third pull is a textile webbing that attaches to the third zipper;

wherein the third pull forms a grip;

wherein the fourth zipper comprises a seventh flexible interlocking edge, an eighth flexible interlocking edge, and a fourth pull;

wherein the seventh flexible interlocking edge is the first interlocking structure of the fourth zipper;

wherein the eighth flexible interlocking edge is the second interlocking structure of the fourth zipper;

wherein the fourth pull is a textile webbing that attaches to the fourth zipper;

wherein the fourth pull forms a grip;

wherein the fifth zipper comprises a ninth flexible interlocking edge, a tenth flexible interlocking edge, and a fifth pull;

wherein the ninth flexible interlocking edge is the first interlocking structure of the fifth zipper;

wherein the tenth flexible interlocking edge is the second interlocking structure of the fifth zipper;

wherein the fifth pull is a textile webbing that attaches to the fifth zipper;

wherein the fifth pull forms a grip.

2. The convertible structure according to claim 1 wherein the span of the length of the first zipper equals the span of the length of the first edge of the mesh sheeting;

wherein the span of the length of the second zipper equals the span of the length of the third edge of the mesh sheeting;

wherein the span of the length of the third zipper equals one quarter of the span of the length of the second edge of the mesh sheeting;

wherein the span of the length of the fourth zipper equals one quarter of the span of the length of the second edge of the mesh sheeting;

wherein the span of the length of the fifth zipper equals one quarter of the span of the length of the second edge of the mesh sheeting.

3. The convertible structure according to claim 2 wherein the plurality of handles comprises a first handle, a second handle, a third handle, and a fourth handle;

wherein the first handle is a textile webbing that forms a loop on the first edge of the mesh sheeting;

wherein the second handle is a textile webbing that forms a loop on the first edge of the mesh sheeting;

wherein the third handle is a textile webbing that forms a loop on the third edge of the mesh sheeting;

wherein the fourth handle is a textile webbing that forms a loop on the third edge of the mesh sheeting.

4. The convertible structure according to claim 3 wherein the plurality of anchor points comprises a first anchor point, a second anchor point, a third anchor point, and a fourth anchor point;

wherein the first anchor point is a textile webbing that forms an anchor point at the first corner of the mesh sheeting;

wherein the second anchor point is a textile webbing that forms an anchor point at the second corner of the mesh sheeting;

wherein the third anchor point is a textile webbing that forms an anchor point at the third corner of the mesh sheeting;

wherein the fourth anchor point is a textile webbing that forms an anchor point at the fourth corner of the mesh sheeting.

5. The convertible structure according to claim 4 wherein the first flexible interlocking edge of the first zipper attaches to the first edge from the fourth corner to the first corner;

wherein the second flexible interlocking edge of the first zipper attaches to face of the mesh sheeting from the fourth edge midpoint of the fourth edge to the second edge midpoint of the second edge;

wherein the third flexible interlocking edge of the second zipper attaches to face of the mesh sheeting from the fourth edge midpoint of the fourth edge to the second edge midpoint of the second edge;

wherein the fourth flexible interlocking edge of the second zipper attaches to the third edge from the third corner to the second corner;

wherein the fifth flexible interlocking edge of the third zipper attaches to the fourth edge from the fourth corner to the first fourth edge quarter point;

wherein the sixth flexible interlocking edge of the third zipper attaches to the second edge from the first corner to the first second edge quarter point;

wherein the seventh flexible interlocking edge of the fourth zipper attaches to the fourth edge from the first fourth edge quarter point to the fourth edge midpoint;

wherein the eighth flexible interlocking edge of the fourth zipper attaches to the second edge from the first second edge quarter point to the second edge midpoint;

wherein the ninth flexible interlocking edge of the fifth zipper attaches to the fourth edge from the fourth edge midpoint to the second fourth edge quarter point;

wherein the tenth flexible interlocking edge of the fifth zipper attaches to the second edge from the second edge midpoint to the second second edge quarter point.

6. The convertible structure according to claim 5 wherein the first anchor point attaches to the first edge and the second edge such that the first anchor point forms a triangle with the first corner;

wherein the second anchor point attaches to the second edge and the third edge such that the second anchor point forms a triangle with the second corner;

wherein the third anchor point attaches to the third edge and the fourth edge such that the third anchor point forms a triangle with the third corner;

wherein the fourth anchor point attaches to the fourth edge and the first edge such that the fourth anchor point forms a triangle with the fourth corner.

7. The convertible structure according to claim 6 wherein to configure the convertible structure as a single bag of maximum volume: a) the convertible structure of the first zipper attaches to the fourth flexible interlocking edge of the second zipper; b) the seventh flexible interlocking edge of the fourth zipper attaches to the ninth flexible interlocking edge of the fifth zipper.

8. The convertible structure according to claim 7 wherein to configure the convertible structure as two separate containment bags: d) the first flexible interlocking edge of the first zipper attaches to the second flexible interlocking edge of the first zipper; e) the fourth flexible interlocking edge of the second zipper attaches to the third flexible interlocking edge of the second zipper; f) the sixth flexible interlocking edge of the third zipper attaches to the eighth flexible interlocking edge of the fourth zipper.

9. The convertible structure according to claim 8 wherein to configure the convertible structure for storage: h) the first flexible interlocking edge of the first zipper attaches to the second flexible interlocking edge of the first zipper; i) the fourth flexible interlocking edge of the second zipper attaches to the third flexible interlocking edge of the fourth zipper; j) the fifth flexible interlocking edge of the third zipper attaches to the sixth flexible interlocking edge of the third zipper; k) the seventh flexible interlocking edge of the fourth zipper attaches to the eighth flexible interlocking edge of the fourth zipper; l) the ninth flexible interlocking edge of the fifth zipper attaches to the tenth flexible interlocking edge of the fifth zipper.

10. The convertible structure according to claim 9 wherein the convertible structure further comprises a plurality of pickets, one or more pockets, and a label panel;

wherein the plurality of pickets further converts the convertible structure into a canopy;

wherein the one or more pockets provided securable storage pouches that allow for the storage of small items with the convertible structure;

wherein the label panel allows the visible display of messages on the convertible structure.

11. The convertible structure according to claim 10 wherein each of the plurality of pickets is a shaft;

wherein each of the plurality of pickets are identical;

wherein the plurality of pickets comprises a first picket, a second picket, a third picket, and a fourth picket;

wherein the first picket comprises a first shaft, a first tip, and a first pointed tip;

wherein the first shaft is a shaft;

wherein the first tip is a first working element of the first shaft that attaches to the first anchor point;

wherein the first pointed tip is a second working element of the first shaft;

wherein the second picket comprises a second shaft, a second tip, and a second pointed tip;

wherein the second shaft is a shaft;

wherein the second tip is a third working element of the second shaft that attaches to the second anchor point;

wherein the second pointed tip is a fourth working element of the second shaft;

wherein the third picket comprises a third shaft, a third tip, and a third pointed tip;

wherein the third shaft is a shaft;

wherein the third tip is a fifth working element of the third shaft that attaches to the third anchor point;

wherein the third pointed tip is a sixth working element of the third shaft;

wherein the fourth picket comprises a fourth shaft, a fourth tip, and a fourth pointed tip;

wherein the fourth shaft is the shaft;

wherein the fourth tip is a seventh working element of the fourth shaft that attaches to the fourth anchor point;

wherein the fourth pointed tip is an eighth working element of the fourth shaft.

12. The convertible structure according to claim 11 wherein each of the one or more pockets is a pouch that is formed on the mesh sheeting;

wherein the one or more pockets store incidental objects.

13. The convertible structure according to claim 12 wherein the label panel is a message that is visually displayed on the mesh sheeting.

14. The convertible structure according to claim 13 wherein the first tip of the first picket attaches to an end of the first shaft of the first picket;

wherein the first pointed tip of the first picket is formed on the end of the first shaft of the first picket that is distal from the first tip;

wherein the second tip of the second picket attaches to an end of the second shaft of the second picket;

wherein the second pointed tip of the second picket is formed on the end of the second shaft of the second picket that is distal from the second tip;

wherein the third tip of the third picket attaches to an end of the third shaft of the third picket;

wherein the third pointed tip of the third picket is formed on the end of the third shaft of the third picket that is distal from the third tip;

wherein the fourth tip of the fourth picket attaches to an end of the fourth shaft of the fourth picket;

wherein the fourth pointed tip of the fourth picket is formed on the end of the fourth shaft of the fourth picket that is distal from the fourth tip.

15. The convertible structure according to claim 14 wherein the first tip of the first picket tips onto the first anchor point while the first pointed tip is driven into a horizontal surface;

wherein the second tip of the second picket tips onto the second anchor point while the second pointed tip is driven into a horizontal surface;

wherein the third tip of the third picket tips onto the third anchor point while the third pointed tip is driven into a horizontal surface;

wherein the fourth tip of the fourth picket tips onto the fourth anchor point while the fourth pointed tip is driven into a horizontal surface.

* * * * *